US009093009B2

(12) United States Patent
Khongbantabam

(10) Patent No.: US 9,093,009 B2
(45) Date of Patent: Jul. 28, 2015

(54) DISPLAY MODULE

(71) Applicant: Stramos Oy, Helsinki (FI)

(72) Inventor: Nabakumar Singh Khongbantabam, Espoo (FI)

(73) Assignee: STRAMOS OY, Helsinki (FI)

( * ) Notice: Subject to any disclaimer, the term of this patent is extended or adjusted under 35 U.S.C. 154(b) by 159 days.

(21) Appl. No.: 13/758,139

(22) Filed: Feb. 4, 2013

(65) Prior Publication Data

US 2014/0218348 A1 Aug. 7, 2014

(51) Int. Cl.

| | |
|---|---|
| ***G09G 5/00*** | (2006.01) |
| ***G09G 3/00*** | (2006.01) |
| ***G09G 3/20*** | (2006.01) |

(52) U.S. Cl.

CPC ..... *G09G 5/003* (2013.01); *G09G 3/003* (2013.01); *G09G 3/2088* (2013.01); *G09G 3/2092* (2013.01); *G09G 2300/026* (2013.01); *G09G 2300/0426* (2013.01); *G09G 2356/00* (2013.01); *G09G 2370/10* (2013.01)

(58) Field of Classification Search

USPC ..... 345/1.1

See application file for complete search history.

(56) References Cited

U.S. PATENT DOCUMENTS

| | | | | |
|---|---|---|---|---|
| 6,065,854 | A | 5/2000 | West et al. | |
| 6,813,853 | B1 | 11/2004 | Tucker | |
| 2006/0044215 | A1* | 3/2006 | Brody et al. | 345/1.3 |
| 2008/0024387 | A1 | 1/2008 | Maskeny et al. | |
| 2008/0174515 | A1* | 7/2008 | Matthies et al. | 345/1.3 |
| 2012/0062475 | A1* | 3/2012 | Locker et al. | 345/173 |
| 2013/0076597 | A1* | 3/2013 | Becze | 345/1.3 |

FOREIGN PATENT DOCUMENTS

| | | | |
|---|---|---|---|
| EP | 0042122 | A2 | 12/1981 |
| EP | 2042983 | A2 | 4/2009 |

* cited by examiner

*Primary Examiner* — Charles V Hicks

(74) *Attorney, Agent, or Firm* — Young & Thompson

(57) ABSTRACT

A display module which can be used as a part of a display assembly includes a box wherein a display matrix unit, a driver arrangement, a control unit, and a memory unit are located. The display matrix unit provides a front face of the box. The box has at least three edges, each of them including a mechanical lock part and a communication interface.

20 Claims, 11 Drawing Sheets

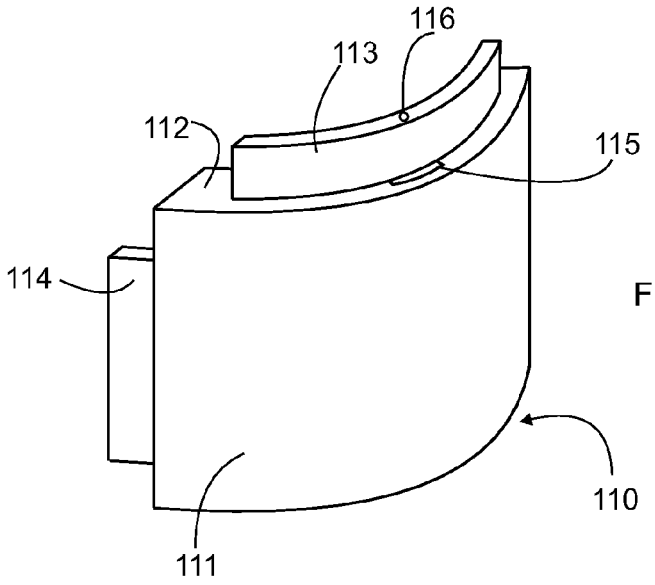
FIG. 11
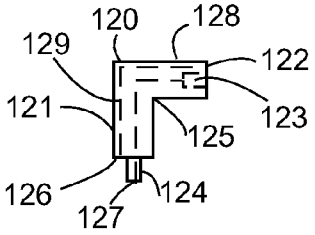
FIG. 12
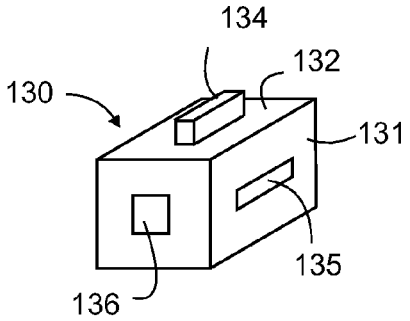
FIG. 13
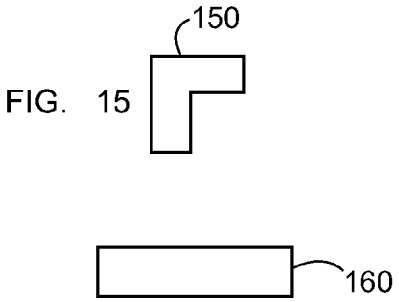
FIG. 15
FIG. 16
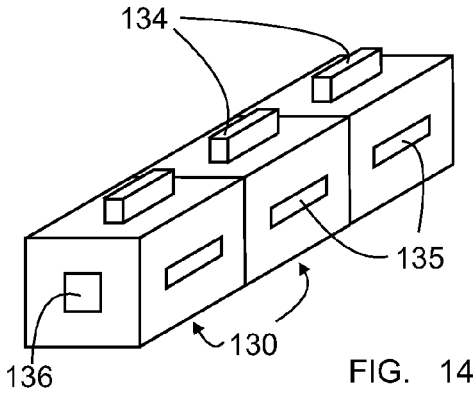
FIG. 14

DISPLAY MODULE

FIELD OF TECHNOLOGY

The present invention relates to displays that are used to in stands, department stores, exhibitions and in any suitable place for advertising and showing products, services etc. The displays are capable of showing images, videos, slideshows etc.

PRIOR ART

The displays that are used for advertising, for example in department stores, are constructed from several display modules. The modules are installed into a frame structures. There exist a number of different frame and module structures. One display or a combination of the several displays installed together provides a display assembly. The display assembly is used to show image data.

The publication EP 2042983 shows a display wherein display modules are installed into a frame. Each module comprises a microprocessor. The microprocessors are connected to nodes. The nodes in turn are connected to an external controller, via a data bus. The embodiment of EP 2042983 illustrates a usual structure of the prior art. This kind of structure makes is possible to build two-dimensional displays of different sizes. The structures of known displays are relatively complex due to the frame structures and wiring of each display module to the external controller. So, the construction of any larger display is tedious and time consuming. Image data of the whole display assembly is sent from the external controller to all display modules. Each module recognizes data meant for it.

It is also known that display module comprises an electronic matrix board that can be sealed between protective layers. The front surface of the display module may comprise an antireflective layer. There are different techniques to construct a display module. There exist, for example, LED (Light Emitting Diode) displays, LCD (Liquid Crystal Display) displays, and OLED (Organic Light Emitting Diode) displays. Further, the LED display can be based on RBG LEDs.

SHORT DESCRIPTION

The aim of the invention is to alleviate above said problems. An embodiment according to the invention provides a display module that can be used as a part of a display assembly. The display module comprises a display matrix unit, a driver arrangement connected to the display matrix unit, a control unit connected to the driver arrangement, and a memory unit. The memory unit can be inside the control unit or can be a separate unit connected to the control unit. The driver arrangement drives the display matrix unit. The display matrix unit comprises also a box wherein the display matrix unit, the driver arrangement, the control unit, and the memory unit are located. The display matrix unit provides a front face of the box.

The box has at least three edges, each of them comprising a mechanical lock part and a communication interface. The mechanical lock part and the communication interface are connectable with another uniform display module. So, several display modules can be connected with each other without using any frame. The control unit is connected to the communication interfaces and has an additional interface for another control unit. The control unit is also arranged to control the driver arrangement, display mapping tasks and image data communication. The box further comprises power distribution equipment.

By connecting the other control unit to the additional interface of the control unit at any one display module of the display assembly, the assembly can receive image data from outside. In addition, three-dimensional displays can be built, if a corner piece or several corner pieces are used to connect two or more display faces together.

LIST OF FIGURES

In the following, the invention is described in more detail by reference to the enclosed drawings, where FIG. 1 illustrates an example of a two-dimensional display assembly according to the invention, FIG. 2 illustrates an example of a three-dimensional display assembly according to the invention, FIG. 3 illustrates an example of a display module according to invention, FIG. 4 illustrates an example of a display matrix unit, FIG. 5 illustrates the example of FIG. 3 from another direction, FIG. 6 illustrates the box of FIG. 3, FIG. 7 illustrates an example of another embodiment of the box according to the invention, FIG. 8 illustrates an example of yet another embodiment of the box according to the invention, FIG. 9 illustrates an example of yet another embodiment of the box according to the invention, FIG. 10 illustrates the example of FIG. 9 from another direction, FIG. 11 illustrates an example of a curved display module, FIG. 12 illustrates an example of a corner piece, FIG. 13 illustrates an example of another corner piece, FIG. 14 illustrates an example of a combination of the corner pieces of FIG. 13, FIG. 15 illustrates an example of a cover strip, FIG. 16 illustrates an example of another cover strip, FIG. 17 illustrates an example of a schematic figure of the display module according to the invention, FIG. 18 illustrates an example of a schematic figure of the display module according to the invention showing power distribution equipment, FIG. 19 illustrates an example of display mapping, FIG. 20 illustrates an example of data format containing location information of the modules on the display assembly, FIG. 21 illustrates another example of data format containing location information of the modules on the display assembly, FIG. 22 illustrates another example of display mapping, FIG. 23 illustrates an example of image data received by the display assembly, FIG. 24 illustrates another example of image data received by the display assembly, FIG. 25 illustrates an example of flow chart illustrating a method for running in the display module according to the invention, FIG. 26 illustrates a further embodiment of the box.

Figure 27:
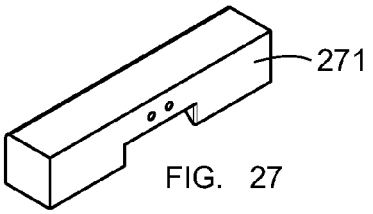
FIG. 27 illustrates another example of a female corner piece.
Figure 28:
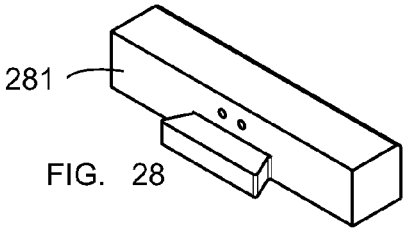
FIG. 28 illustrates another example of a male corner piece.
Figure 29:
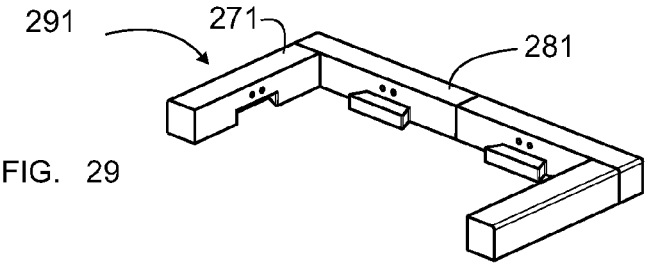
Figure 30:
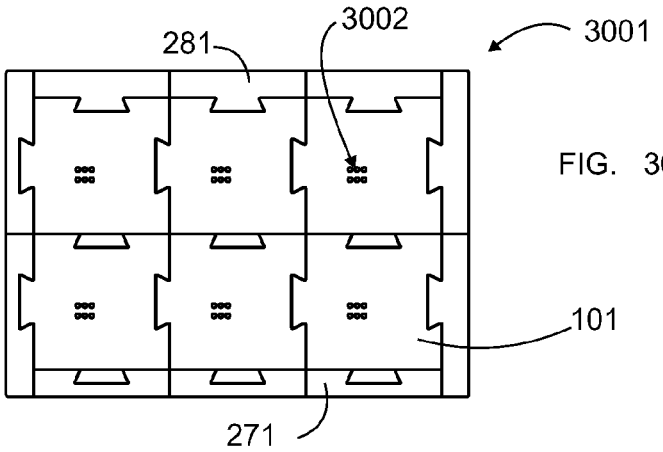
Figure 31:
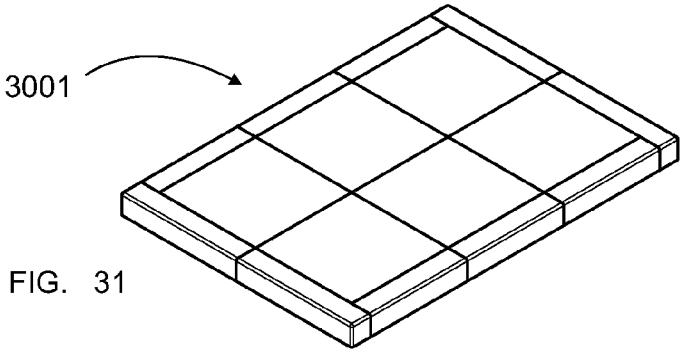
Figure 32:
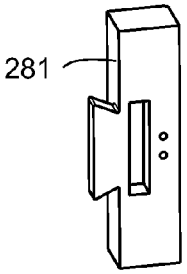
Figure 33:
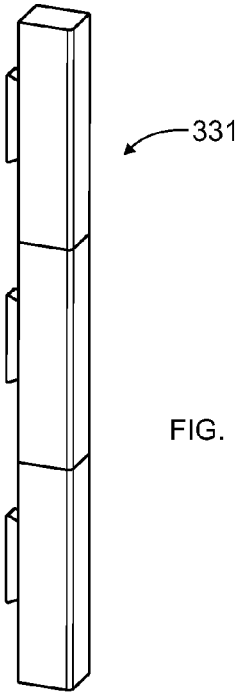
Figure 34:
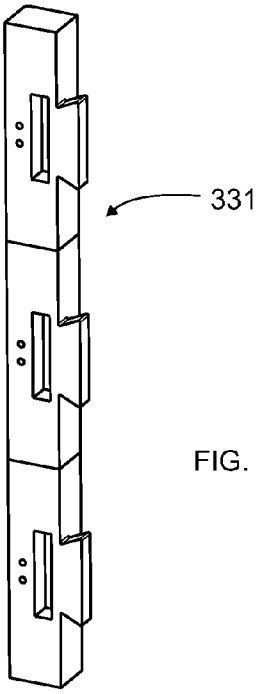
Figure 35:
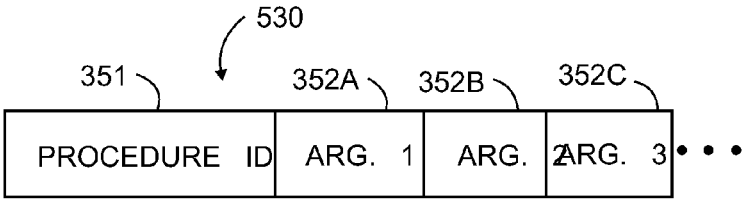

FIG. 29 illustrates an example of how the corners pieces of FIGS. 27 and 28 can be connected, FIG. 30 illustrates a schematic example of a display assembly with the corner pieces, FIG. 31 illustrates the example of FIG. 30. from another direction, FIG. 32 illustrates a rear view from the corner piece of FIG. 28, FIG. 33 illustrates an example of a corner strip having several lock parts, FIG. 34 illustrates a rear view of the example of FIG. 33, FIG. 35 illustrates an example of a data communication protocol between the display modules.

DESCRIPTION

Figure 1:
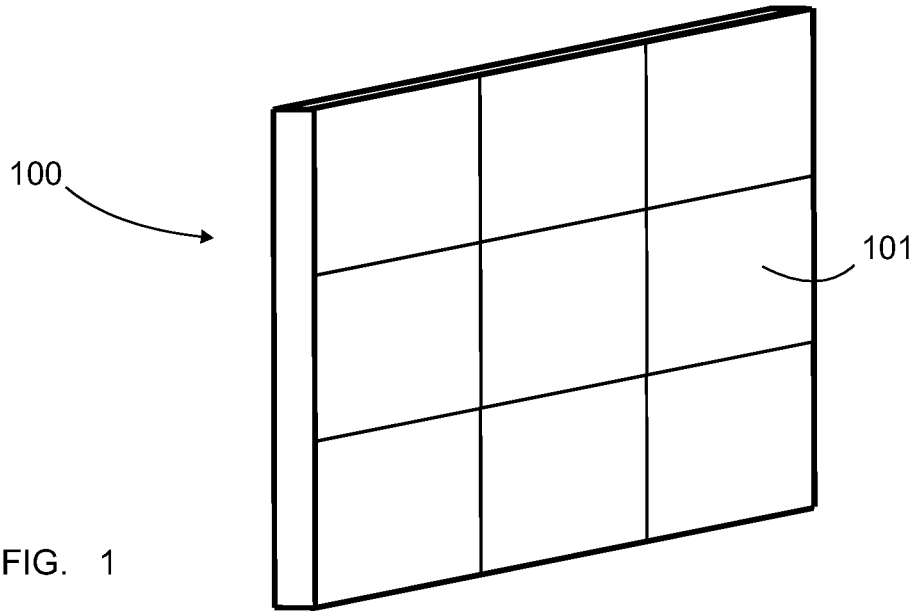

FIG. 1 illustrates an example of a two-dimensional display assembly 100. The assembly is composed of nine display modules 101 according to the invention. The display module comprises a box 300 (FIG. 3) wherein other parts of the modules are. The other parts are illustrated, for example in FIGS. 17 and 18. A display matrix unit 304 provides a front face of the display module. Any additional frame structure or frame structures are not needed, because the box is rigid and it can be connected directly to other uniform display modules.

Figure 2:
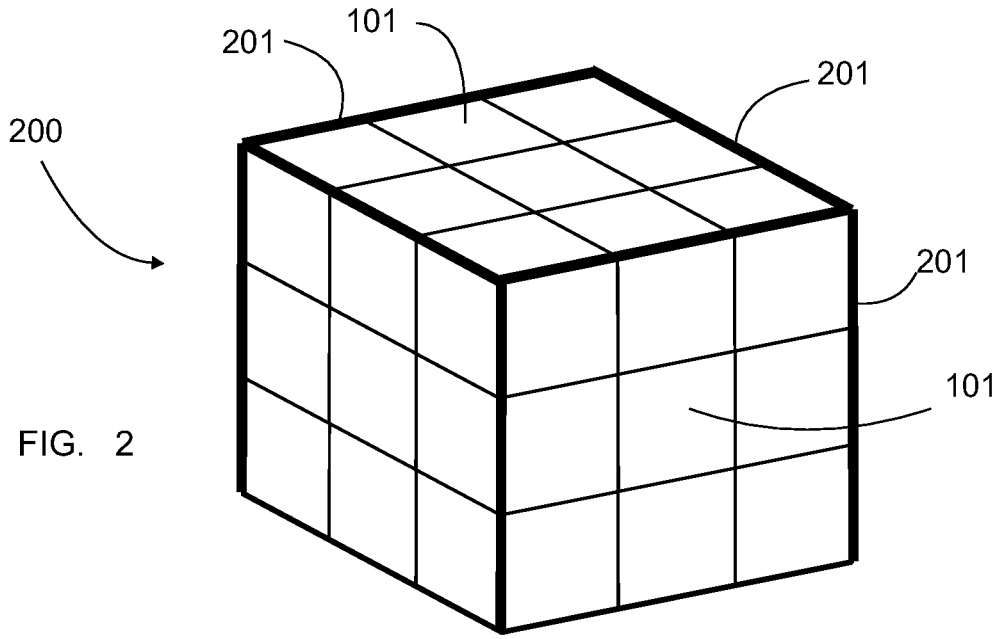

FIG. 2 illustrates an example of a three-dimensional display assembly 200 according to the invention. The three-dimensional display assembly is possible to build by using a corner piece or several corner pieces at the edges 201 of the faces of the three-dimensional display as showed in FIG. 2. The corner pieces are described in more detail below.

Figure 3:
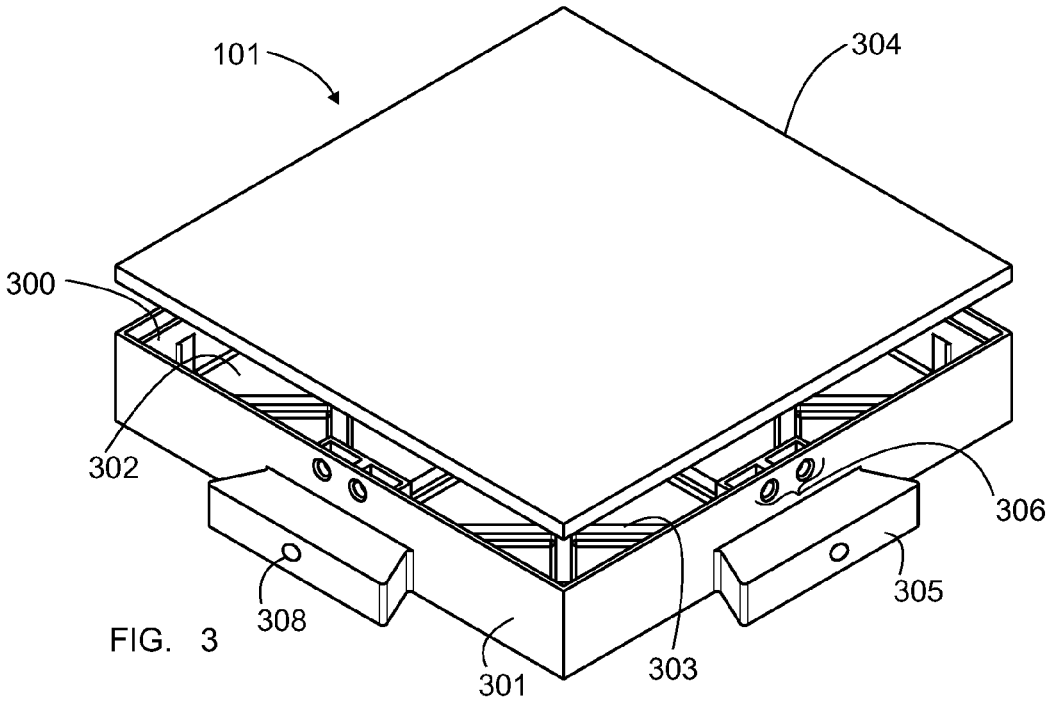

FIG. 3 illustrates an example of a display module 101. FIG. 5 illustrates the same example from another direction. The both figures show the display matrix unit 304 that is described in more detail in FIG. 4. The box 300 has four edges 301. Each edge comprises a mechanical lock part 305. The mechanical lock parts are male 305 and female lock parts 500 in this example, but the lock parts can also be hermaphroditic, i.e. they are similar on the each edge of the box.

Each edge comprises also a communication interface 306. The communication interface can be an optical interface or metal (galvanic) interface. In addition the communication interface may comprise separate interfaces for receiving and sending as showed in the example of FIG. 3. Infrared sensor and emitters can be used for providing the optical interface. However, it is possible that the communication interface is formed to be only one physical connector that is capable of receiving and sending data.

The box 300 further comprising power distribution equipment (FIG. 18) having at least one power connector for connecting outside the box. If the box has only one power connector outside, it is convenient to be on the bottom 302 of the box. However, a more practical embodiment is that each edge 301 of the box comprises the power connector 308 as showed in FIG. 3. The communication interfaces 306 and power connectors 308 can be formed in such a way that they provide the connections and at the same time do not hinder the mechanical connection between the display modules 101. Also the power connector can be formed to have a single physical unit (for example, coaxial) or two or more physical units (like separate connector units for positive, negative and ground lines). In this context, the term power connector contains all these possibilities. It is also possible to use a battery inside the box for providing power. In this case, the power connector for outside is not needed.

Figure 7:
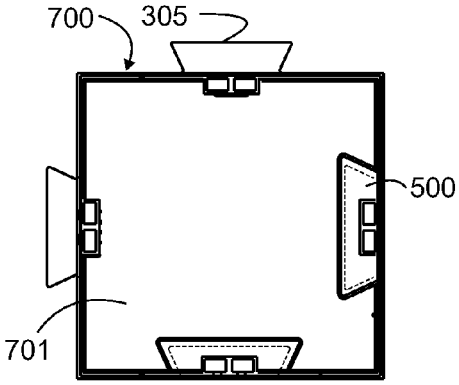
Figure 8:
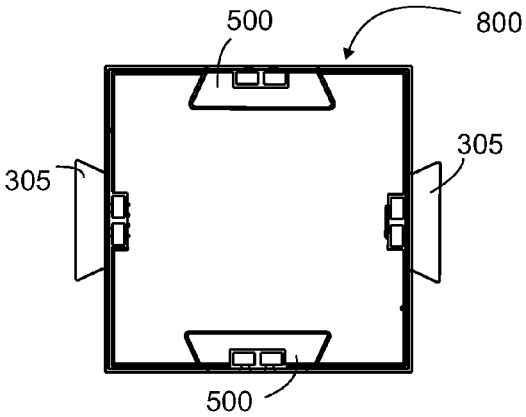

The bottom 302 of the box may comprise stiffeners 303. In this way a relatively light bottom structure can be achieved without decreasing rigidity of the box. FIG. 5 illustrates an embodiment how the stiffeners can, for example, be formed. FIGS. 7 and 8 illustrates other embodiments 700, 800 of the box having no stiffeners in which case the bottom 701 of the box is rigid enough without the stiffeners.

Figure 6:
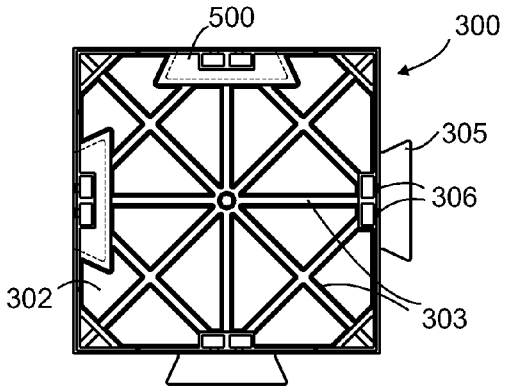

As can be seen from the embodiment of FIG. 6, the box can be provided with two male mechanical lock parts 305 and two female mechanical lock parts 500. In this embodiment the male lock parts are situated on the two edges 301 being transversal in relation to each other. The female lock parts 500 are at the corresponding opposite edges. However, the male and female lock parts can be located in another way as showed in FIG. 8 where the male lock parts are on the opposite edges of the box, and the female lock parts are respectively on the transversal edges.

Figure 9:
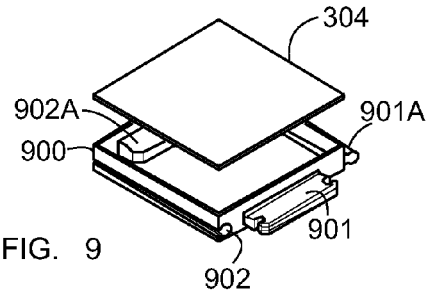
Figure 10:
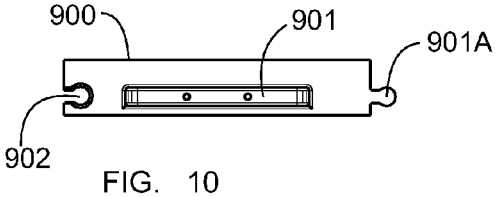

FIGS. 9 and 10 illustrate yet another example of the box 900 and it's lock parts 901, 901A, 902, 902A according to the invention. In this embodiment each mechanical lock part has a different shape with respect to each other. The male lock part 901 and the female lock part 902A provide a matching pair. The other male 901A and female 902 lock parts provide also a matching pair.

Figure 4:
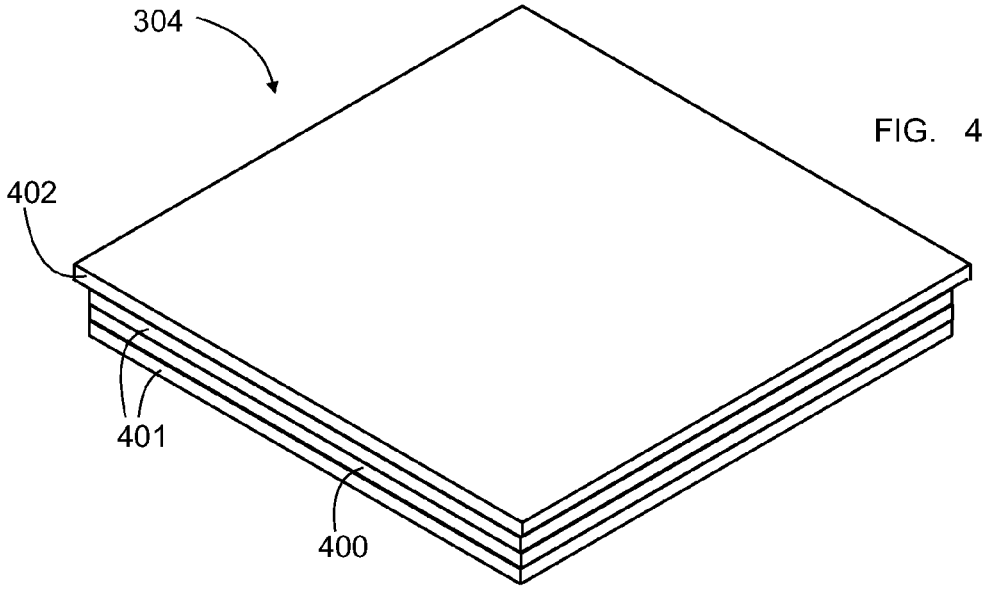
Figure 5:
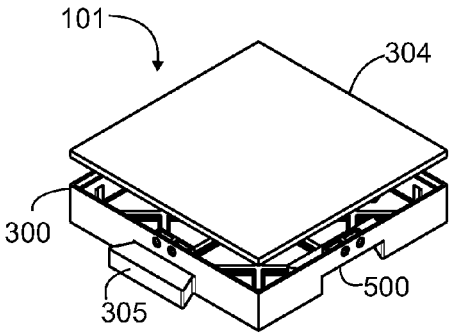

FIG. 4 illustrates an example of a display matrix unit 304. FIG. 4 shows only one possible embodiment for the display matrix unit. The unit can be composed of an electronic matrix board 400 that is between protective layers 401. The front layer 402 can be slightly larger than the other layers for matching the box 300 in order to provide the front face that can be seen. The front layer may comprise antireflective film and lenses. In addition, the front faces of the adjacent display modules provide a uniform display surface without any frame structure between the display modules. The electronic matrix board provides pixels from which an image is performed. There exist different technical solutions for forming the electronic matrix. The display matrix unit in often named according to the used type of technique or luminous elements, like LED, LCD, OLED or RBG LED displays.

FIG. 11 illustrates an example of a curved display module 110 that can used for forming a three-dimensional display assembly, for example, a cube as showed in FIG. 2. In this embodiment the box 112 and the display matrix unit 111 are performed to have a curved shape. The edges are provided with mechanical lock parts 113,114 and communication interfaces 115 similarly as the examples above. By using the curved display module 110 different faces at different directions can be built for providing three-dimensional display assembly. In addition, the edges can be provided with power connectors 116.

The box 300 is made of plastic or any other suitable material. The size of the box can be any. A possible practical size is 10 cm*10 cm.

FIG. 12 shows an example of a corner piece 120 that can be used at the edges 201 of the faces of the three-dimensional display as showed in FIG. 2. The corner piece 120 has two arms 121, 128, each arm having an edge 126, 122 that comprises a mechanical lock part 123, 124, and a communication interface 129. The communication interfaces of the edges are in connection with each other. The dashed line 129 in FIG. 12 illustrates both the connection and the interfaces. The corner piece may also comprise power connectors on the edges and the connection between them, which are illustrated as another dashed line 127 in FIG. 12. The angle 125 between said arms of the corner piece can be 1-180 degrees.

FIG. 13 illustrates an example of another corner piece 130. This embodiment does not have arms, but it has still two transversal edges 131, 132 having mechanical lock parts 134, 135. In addition, it is practical that a corner has additional lock parts 136 for connecting the corner piece with other corner pieces. The additional lock parts make it possible to form a long corner strip as illustrated in FIG. 14. The corner piece can be formed in many other ways as well. It can be, for example, a long rim, or the profile of the piece can have three corners, or the profile can be curved.

FIG. 15 illustrates an example of a cover strip 150 having a corner shape profile. FIG. 16 illustrates an example of another cover strip 160 having a longitudinal profile. The cover strips are used for edges of a display assembly to achieve a nice outlook.

Figure 17:
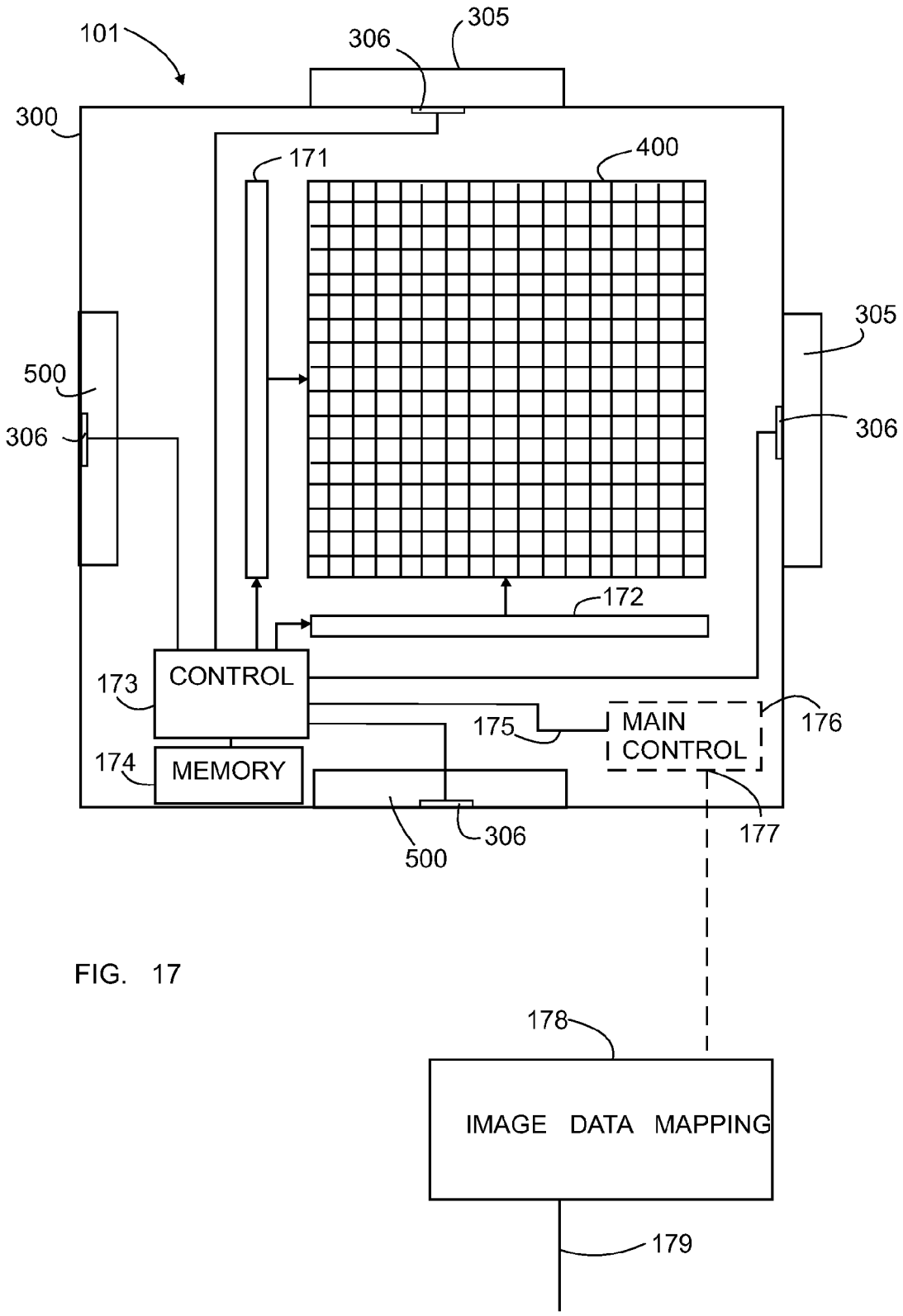

FIG. 17 illustrates an example of a schematic figure of the display module 101 according to the invention. The box 300 comprises a display matrix unit 400, a driver arrangement 171, 172, a control unit 173, and a memory unit 174 (in this example as a separate unit but can also be inside the control unit). The communication interfaces can be either all controlled by the control unit directly or separately multiplexed and de-multiplexed outside the control unit. Further, the communication interfaces can be either implemented by the control unit or implemented by external units. The matrix unit can, for example, contain 16*16 pixels. The driver arrangement 171, 172 is connected to the display matrix unit 400 to drive the display matrix unit. The driver arrangement can be a single entity, and it can be an integrated part of the control unit. However, it is practical to utilize the driver arrangement as a separate element from the control unit 173. In addition, it is also practical to have two driver (or even more) elements as showed in FIG. 17. The driver arrangement of FIG. 17 has a row driver 171 and a column driver 172. There exist different known drivers for the matrix unit 400. The control unit 173 is connected to the driver arrangement, and the memory unit 174 is connected to the control unit.

The display matrix unit 400 provides a front face of the box as said above, and the box has four edges, each of them comprising a mechanical lock part 305, 500 and a communication interface 306. The mechanical lock parts and the communication interfaces are connectable with other uniform display modules. The control unit is connected to the communication interfaces 306, and it has an additional interface 175 for a data communication module 176. The control unit is also arranged to control the driver arrangement, display mapping tasks and image data communication.

The data communication module 176 that can be connected to said additional interface 175, has a further communication interface 177 through which the data communication module can be connected to an external unit 178. The display module (control unit) whose additional interface 175 is connected to the data communication module is arranged to start and finish display mapping. The external unit 178 can transmit image data to the data communication module that in turn transmit the image data to the control unit 173. The data communication module 176 is, to send data of the display mapping outside via the further communication interface, and to receive image data from the further communication interface 177, that can be a wireless interface or wire connection. The functions of the data communication module and the external unit 178 are described in more detail below. The data communication module can be placed in the display module 101 as showed in FIG. 17, in the external unit 178 or somewhere between the display module and the external unit.

Figure 18:
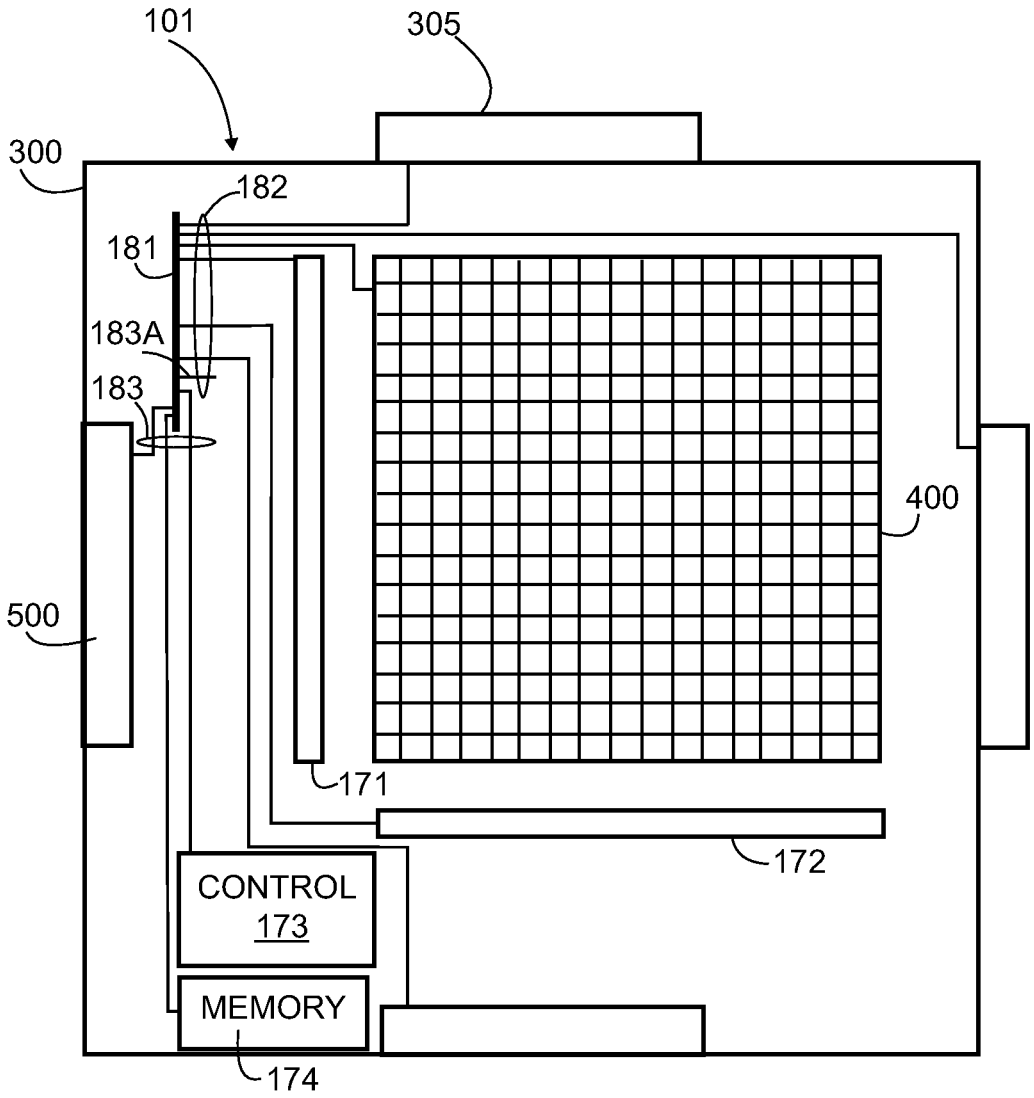

FIG. 18 illustrates an example of a schematic figure of the display module according to the invention showing power distribution equipment 181, 182, 183. The display module 101 can contain a node 181 or nodes for distributing power to different devices, like the control unit 173 and a display matrix unit 400. The distribution is provided via power distribution lines 182, 183. At least one distribution line 183A is reserved for the data communication module 176, if it is installed in the display module 101. As already said it is practical to have power connection on each edge of the box 300.

FIG. 35 illustrates an example of a Remote Procedure Call (RPC) protocol that can be used for data communication between the display modules. The RPC comprises a packet format 350 containing a procedure ID 351 package signifying the procedure to perform, an optional Call ID indicating specific instance of the call and specific data packages 352A-532C for data (called arguments) for the procedure that is defined by the procedure ID package. The procedure ID package 351 specifies a predefined procedure. A response message for this kind of RPC packet comprises one or more ID fields (corresponding to the Procedure and Call IDs) and response packages for the data packages 352A-352C. The RPC or other protocols can be used for data communication between the display modules.

Figure 19:
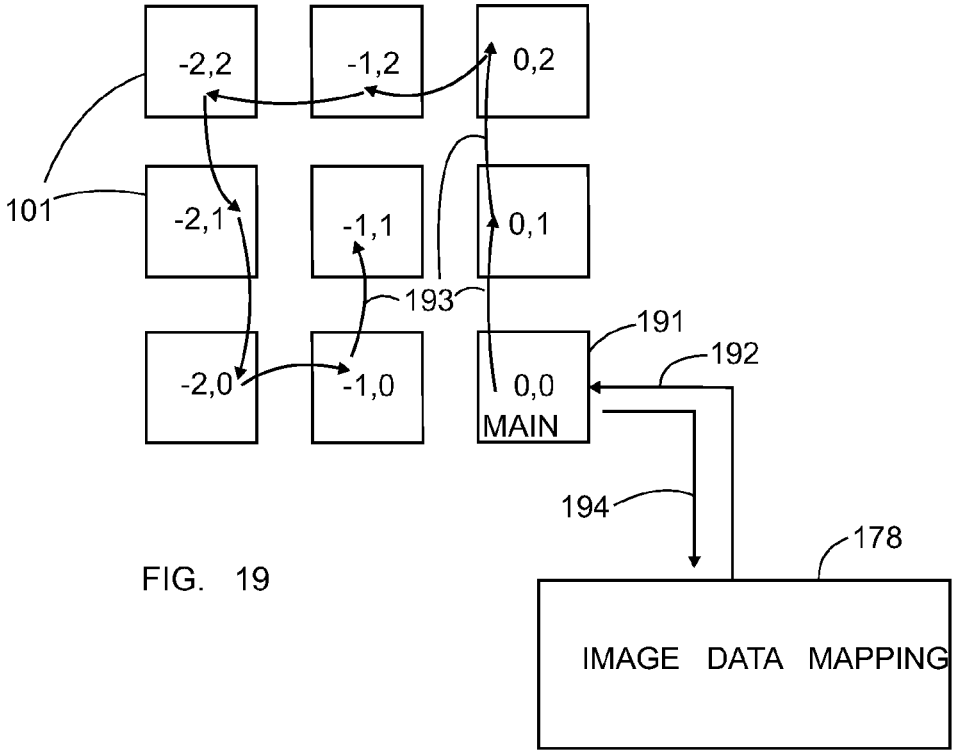

FIG. 19 illustrates an example of display mapping. The display mapping is functions to solve the size and the shape of a display assembly and also the locations of the display modules in order to make it possible to provide image data for that specific display assembly. FIG. 19 illustrates a mapping algorithm that is called as depth-first traversal algorithm. The display module wherein the data communication module 176 has been installed is called a main display module 191 in this text. The display module connected to the data communication module starts the display mapping by "sending" the first message to the control unit 173 of the main display module 191. This means a virtual sending for starting the mapping algorithm. The first message contains an initial index for location data and direction data. The direction data refers to a coordinate system used in the system. In examples of this description the Cartesian coordinate system is used. The initial indexes of location and direction can be understood as a virtual starting coordinates and direction that the control unit 173 can use for updating the location data and direction data.

So, the control unit 173 of the main display module 191 receives the first message containing location data and direction data. It updates the location data and the direction data of the first message. This means that the main control module defines its location to be in the origin 0,0. Directions of the coordinate are also defined. The updated data is sent forward 193 to another display module 101 that is capable of receiving the updated data. This phase comprises actions wherein the control unit identifies the next possible communication interface for sending the updated data forward. The next possible communication interface can be identified, for example, by pinging the communication interfaces clockwise. Then the main display module waits a response message for the sent updated data until it receives the response. The response message contains response location data, i.e. location data of the other display modules 101.

After receiving the response message the main display module forms the second response message in such a way that it comprises data of the response message, and it's own updated location data. The second response message is send, as response to the first message, to the data communication module.

These phases are repeated in each display module 101. For example, the next display module 101 after the main display module receives the first message (at the point of view of this module) containing location data and direction data. It updates the location data and the direction data of the first message, by adding 1 to the 0,0 in the correct direction of the coordinate. The coordinate directions are determined for update for the next forwarding message in relation to the received direction data.

The updated data is sent forward 193 to another display module that is capable of receiving the updated data. This phase comprises actions wherein the control unit identifies the next possible communication interface for sending the updated data forward. As said, the next possible communication interface can be identified, for example, by pinging the communication interfaces clockwise.

Then the display module waits a response message for the sent updated data. The response message contains response location data, i.e. location data of the next display modules 101. After receiving the response message the display module forms the second response message in such a way that it comprises data of the response message, and it's own updated location data. The second response message is send, as response to the first message, to the main display module.

The mapping messages 193 provide a route going through each display module 101. The last display module founds that it is the last module that was capable of receiving the updated message, so it does not need to send any message forward or wait any message, but it can form the second response message and send it back as response to the first message. The response message goes back via the same route and it collects location date of all display modules. The control units 173 of the display modules 101 are arranged to handle the display mapping functions.

Figure 20:
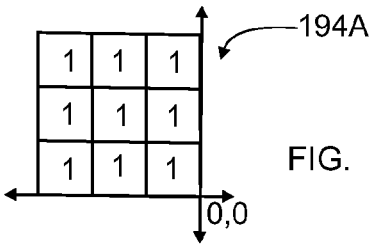
Figure 21:
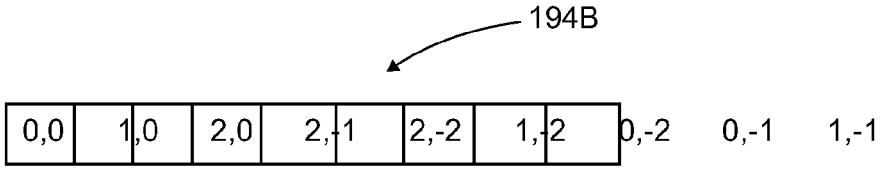

The data communication module 175 of the main display module 191 sends 194 the data of the display mapping outside via the further communication interface 177 to the external unit 178. The external unit utilizes the mapping data for forming image data communication 192 to the display assembly. The mapping data can be sent to the external unit 178, for example, as an array format or a list format. FIG. 20 illustrates the array format 194A that indicates a used coordinate system and active (found) display modules. FIG. 21 illustrates the list format 194B containing coordinates for each display modules. It should also be noted that if the control unit 173 (and the memory) has enough capacity, it may comprise the external unit in software format.

Figure 22:
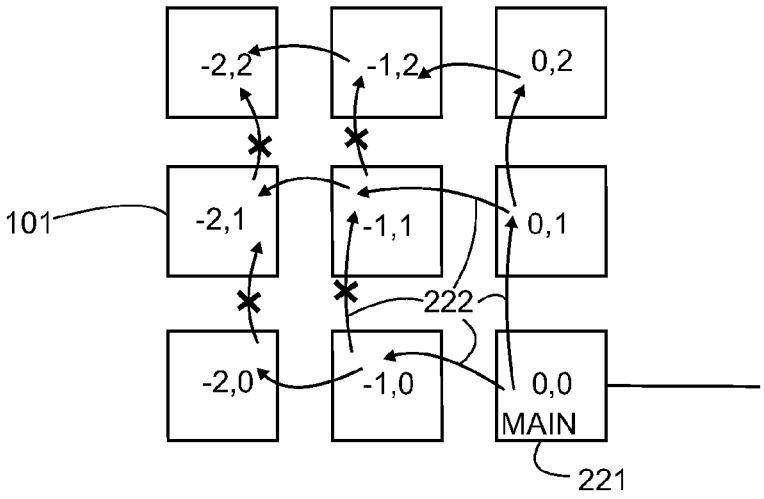

FIG. 22 illustrate another display mapping algorithm that is called as breadth-first traversal algorithm. It has similar features with the algorithm of FIG. 21, but in this case the messages are send 222 to all display modules 101 that are capable of receiving. The display mapping messages starts also in this case in the main display module 221 as described above. Each display module receives a first message containing location data and direction data, and updates the location data and the direction data of the first message. The updated data is sent forward to at least one another display module that is capable of receiving the updated data. After this the display module waits a response message or messages for the sent updated data until the response is received. The response message or messages contain response location data.

The second response message after receiving the response message/messages is formed in such a way that it comprises data of the response message or messages, and said updated location data. The second response message is sent as response to the first message.

The display mapping according to FIG. 22 provides several routes. Some display modules receive two or more forward messages in which case only one forward message win and the others are rejected. The response messages are sent back via the same routes. As can be noted display mapping can be formed in many ways, using different algorithms.

Figure 23:
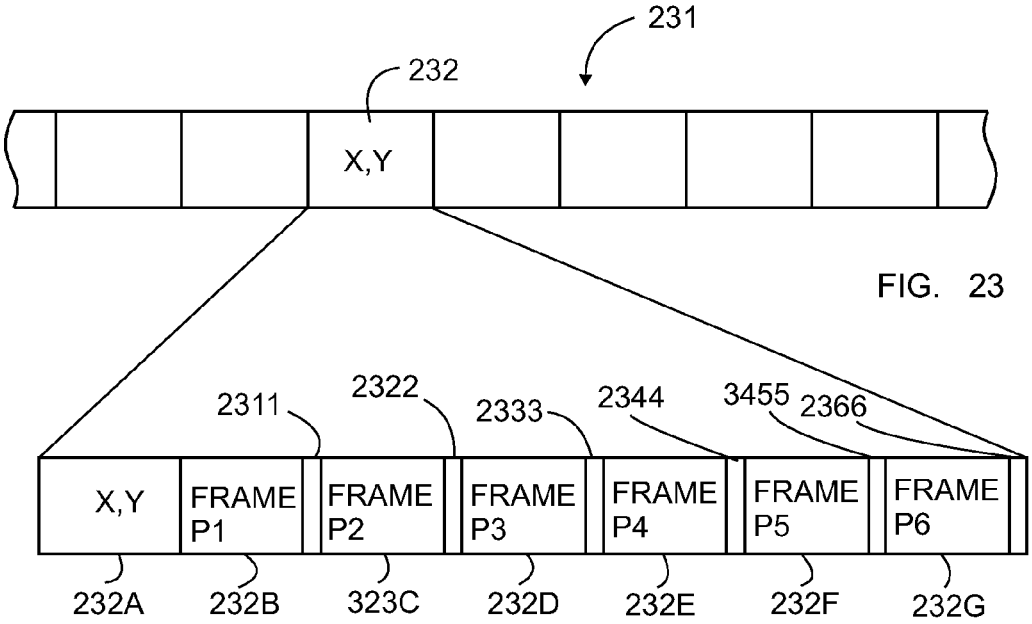

FIG. 23 illustrates an example of image data 231 received by the display assembly. The image data can be any data that is visible data and can be represented on a display. The external unit 178 provides image date. The external unit can be, for example, software that is in a computer. The external unit can also be a special device designed for this purpose. The external unit can have a communication interface 179 for receiving any image data, like videos, slides, pictures, drawings etc. This image data is mapped to a suitable data communication packages in order that the image data can be showed on the display assembly. This mapping is called in this context as image data mapping. FIG. 23 shows the mapped image data that is send to the display assembly. The sent 192 image data 131 comprises packages 232 for each display module. The package comprises an address 232A (coordinates) of the destination display module and image data for this specific display module.

Figure 24:
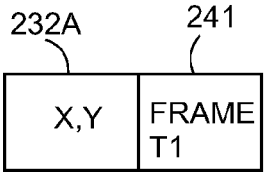

The image data of the package in FIG. 23 comprises parts 232B-232G of a slideshow. Each part is planned to be showed during a slide specific period. The package may also contain transition data 2311-2366 that define instructions how the parts of the slides are going to change to the next part to be showed. In other words, the packages can also contain information to form a final show on the display assembly. Image data and instructions can be kept in the memory of each display module. FIG. 24 illustrates another example of image data received by the display assembly. This information package contains a part of a video 241 and also an address 232A of the display module.

So the main display module receives the incoming image data, and the control unit 173 directs the packages towards the destination modules. The package can be transmitted through the display modules 101 to the destination module by utilizing address information. Referring to the example of FIG. 19, the package addressed to the module −2, 2 can be transmitted from the main display module 191 via the modules 0,1; 0,2; and −1,2. This can be provided, for example, by reducing the address coordinate in the control units of the display modules in such a way that finally the address coordinate is 0,0 indicating that the destination has been received. For example, when transmitting via the above said route, the address coordinate reduces like −2,2; −2,1; −2,0; −1,0; 0,0. There can also be utilized other addressing systems for above described image data communication inside the display assembly.

Figure 25:
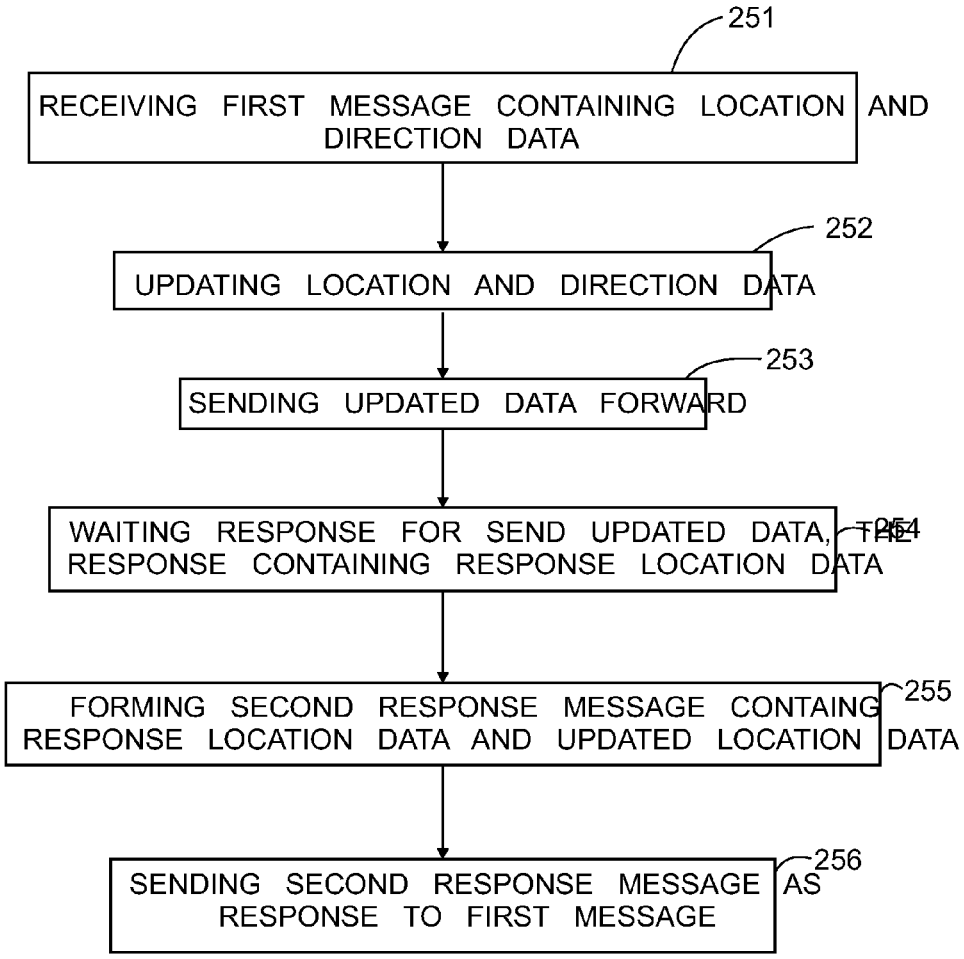

FIG. 25 illustrates an example of flow chart illustrating a method for running in the display module for display mapping. The method comprises the steps of: receiving 251*a* first message containing location data and direction data, updating 252 the location data and the direction data of the first message, and sending 253 the updated data forward to at least one another display module that is capable of receiving the updated data. The method further comprises the steps of: waiting 254 a response message or messages for the sent updated data, said response message or messages containing response location data, forming 255 a second response message when the response message/s are received in such a way that it comprises data of the response message or messages, and said updated location data, and sending 256 the second response message as response to the first message.

Figure 26:
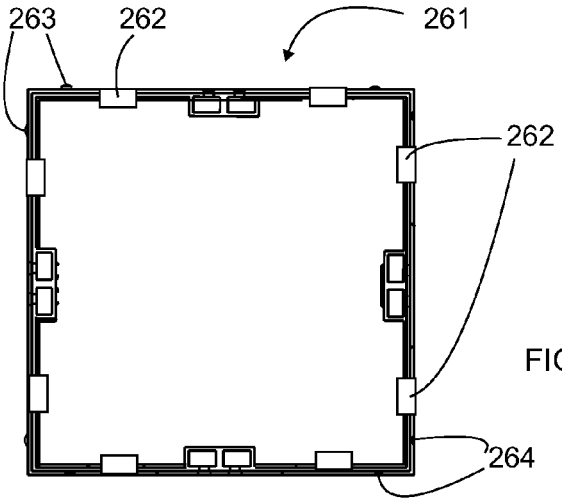

FIG. 26 illustrates yet another embodiment of the box 261 for the inventive display module. In this embodiment the connections between the display modules are provided by using magnets 262. Each edge of the box has at least one magnet, and at least one mechanical guiding lock part 263, 264. Nowadays strong magnets are available, so a strong connection between the modules can be achieved.

FIG. 27 illustrates yet another embodiment of a female corner piece 271 that matches with the display module of FIG. 3. FIG. 28 illustrate a corresponding male corner piece 281. The rear view of the male corner piece is showed in FIG. 32. FIGS. 33 and 34 show an embodiment 331 of a corner strip.

FIG. 29 illustrates how the corner pieces of FIGS. 27 and 28 can be installed 291. FIG. 30 shows a display assembly 3001 having six display modules 101 with the corner pieces 281, 271. This figure is from the back face of the assembly. Power connector interfaces and interfaces for programming 3002 of these embodiments can be seen. FIG. 31 shows the front face of the embodiment of FIG. 30. As can be noted, the final outlook is nice when using the corner pieces.

The invention provides many advantages. The display assembly is easy to build, because the basic display module is the same, and it can be equipped easily to be the main module or having corner property. The display assembly is not restricted to two-dimensional applications, but three-dimensional applications are also possible. Display assemblies of different sizes and shapes can be built. Although the figures of this representation shows the boxes having four edges, it is possible to use a box having at least three edges. So, different shapes of the boxes are possible, like triangular or pentagon. The image data from outside the assembly does not need to be delivered to all display modules that recognize the signals meant to them. Instead, the image data signals can be delivered via a suitable route through the display modules to the destination display module. As can be noted from the description above the inventive display module can be formed in many different ways.

It is evident from the above that the invention is not limited to the embodiments described in this text but can be implemented in many other different embodiments within the scope of the independent claims.

The invention claimed is:

1. A display module for use as a part of a display assembly, the display module comprising:

a display matrix unit, a driver arrangement spaced from and connected to the display matrix unit to drive the display matrix unit, a control unit connected to the driver arrangement, a memory unit, and a box in which the driver arrangement, the control unit, and the memory unit are located, said display matrix unit providing a front face of the box, said box having at least three edges, each of said at least three edges of said box comprising a mechanical lock part and a communication interface, each said mechanical lock part and said communication interface being connectable to a said mechanical lock part and a said communication interface of a said box of another said display module wherein sides of said display matrix unit abut sides of a said display matrix unit of the another said display module without overlapping, the control unit being connected to the communication interfaces and having an additional interface for another control unit, the control unit also being arranged to control the driver arrangement, display mapping, and image data communication, the box further comprising power distribution equipment.

2. The display module according to claim 1, further comprising a data communication module that is connected to said additional interface, said data communication module having a further communication interface, the data communication module being arranged, to send data of the display mapping outside via the further communication interface, and to receive image data from the further communication interface, the display module being arranged to start and finish display mapping.

3. The display module according to claim 1, in which the display matrix unit and the box have a curved shape.

4. The display module according to claim 1, further comprising at least one corner piece that has two edges that comprise a said mechanical lock part, and a said communication interface, said two edges being located transversely in relation to each other, and the corner piece being connected to one of the at least three edges of said box.

5. The display module according to claim 4, in which the corner piece has two arms that comprise said two edges of the corner piece.

6. The display module according to claim 1, in which each said at least three edges of the box comprises a power connector.

7. The display module according to claim 4, in which each said at least three edges of the box comprises a power connector, and the two edges of said corner piece each comprise a further power connector, wherein the power connectors of the two edges of the corner piece are in connection with each other.

8. The display module according to claim 5, further comprising an angle between said arms of the corner piece, the angle being 1-180 degrees.

9. The display module according to claim 1, in which the driver arrangement comprises a row driver and a column driver that are connected to the display matrix and the control unit.

10. The display module according to claim 1, wherein the box comprises four of said mechanical lock part, two of which are male lock parts and two of which are female lock parts.

11. The display module according to claim 1, in which the box comprises stiffeners.

12. The display module according to claim 1, in which the control unit is arranged to receive a first message containing location data indicating a location of the display module within the display assembly and direction data indicating a coordinate system used in the display assembly, to update the location data and the direction data of the first message, to send the updated data forward to at least another display module that is capable of receiving the updated data, to wait for a first response message that is responsive to the sent updated data until receiving the first response message, said first response message containing response location data, the control unit being further arranged to form a second response message that comprises data of the first response message and said updated location data, and to send the second response message as response to the first message.

13. A method of displaying mapping in a display module that is part of a display assembly, the method comprising the steps of:

receiving at a control unit a first message containing location data indicating a location of the display module within the display assembly and direction data indicating a coordinate system used in the display assembly, updating the location data and the direction data of the first message, the control unit being arranged inside a box that has a front face that is a display matrix unit and a driver arrangement inside the box that is spaced from and drives the display matrix unit and is controlled by the control unit, the box having at least three edges, each of the at least three edges of the box having a mechanical lock part and a communication interface, the mechanical lock part and the communication interface being connectable with a said mechanical lock part and a said communication interface of a said box of another said display module wherein sides of said display matrix unit abut sides of a said display matrix unit of the another said display module without overlapping, the control unit being connected to the communication interfaces and having an additional interface for another control unit, the control unit being also arranged to control display mapping and image data communication, the box also including power distribution equipment, sending the updated data forward to at least another display module that is capable of receiving the updated data, waiting for a first response message that is responsive to the sent updated data until receiving the first response message, said first response message containing response location data, forming a second response message in such a way that it comprises data of the first response message and said updated location data, and sending the second response message as response to the first message.

14. A display module for using as a part of a display assembly, comprising:

a display matrix unit, a driver arrangement spaced from and connected to the display matrix unit to drive the display matrix unit, control unit connected to the driver arrangement, a memory unit, and a box in which the driver arrangement, the control unit, and the memory unit are located, said display matrix unit providing a front face of the box, said box having at least three edges, each of the at least three edges of the box comprising at least one magnet, at least one mechanical guiding lock part and a communication interface, said magnet, mechanical guiding lock part and said communication interface being connectable with a said magnet, a said mechanical lock part, and a said communication interface of a said box of another said display module wherein sides of said display matrix unit abut sides of a said display matrix unit of the another said display module without overlapping, the control unit being connected to the communication interfaces and having an additional interface for another control unit, the control unit being also arranged to control the driver arrangement and display mapping and image data communication, the box further comprising power distribution equipment.

15. The display module according to claim 14, further comprising a data communication module that is connected to said additional interface, the data communication module being arranged to send data of the display mapping and to receive image data, the display module being arranged to start and finish display mapping.

16. The display module according to claim 14, in which the control unit is arranged to receive a first message containing location data indicating a location of the display module within the display assembly and direction data indicating a coordinate system used in the display assembly, to update the location data and the direction data of the first message, to send the updated data forward to at least another display module that is capable of receiving the updated data, to wait for a first response message that is responsive to the sent updated data until receiving the first response message, said first response message containing response location data, said control unit being further arranged to form a second response message that comprises data of the first response message and said updated location data, and to send the second response message as a response to the first message.

17. The display module according to claim 2, further comprising at least one corner piece that has two edges that comprise a said mechanical lock part and a said communication interface, said two edges of the at least one corner piece being located transversely in relation to each other, and the corner piece being connected to one of the at least three edges of said box.

18. The display module according to claim 2, in which each of said at least three edges of the box comprises a power connector.

19. The display module according to claim 2, in which the driver arrangement comprises a row driver and a column driver that are connected to the display matrix and the control unit.

20. The display module according to claim 15, in which the control unit is arranged to receive a first message containing location data indicating a location of the display module within the display assembly and direction data indicating a coordinate system used in the display assembly, to update the location data and the direction data of the first message, to send the updated data forward to at least another display module that is capable of receiving the updated data, to wait for a first response message that is responsive to the sent updated data until receiving the first response message, said first response message containing response location data, said control unit being further arranged to form a second response message that comprises data of the first response message and said updated location data, and to send the second response message as a response to the first message.

* * * * *